US008322118B2

(12) United States Patent
Ozias et al.

(10) Patent No.: US 8,322,118 B2
(45) Date of Patent: Dec. 4, 2012

(54) SYSTEMS AND METHODS FOR PACKAGING OF INFORMATION HANDLING SYSTEMS

(75) Inventors: Orin Ozias, Austin, TX (US); Kevin Mundt, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 813 days.

(21) Appl. No.: 12/460,045

(22) Filed: Jul. 13, 2009

(65) Prior Publication Data

US 2011/0010313 A1 Jan. 13, 2011

(51) Int. Cl.
*B65B 1/04* (2006.01)

(52) U.S. Cl. ..... 53/473; 53/487

(58) Field of Classification Search ..... 53/473, 53/476, 480, 485, 487
See application file for complete search history.

(56) References Cited

U.S. PATENT DOCUMENTS

| | | | | |
|---|---|---|---|---|
| 5,398,808 | A * | 3/1995 | Chen et al. | 206/320 |
| 6,685,025 | B1 * | 2/2004 | Kari | 206/583 |
| 8,198,720 | B2 * | 6/2012 | Eng et al. | 257/686 |
| 8,248,557 | B2 * | 8/2012 | Won et al. | 349/65 |
| 2007/0000345 | A1 | 1/2007 | De Nola | |

OTHER PUBLICATIONS

Flexcon, Mail Bin, Printed from Internet Feb. 17, 2009, 11 pgs.

* cited by examiner

*Primary Examiner* — Sameh H. Tawfik
(74) *Attorney, Agent, or Firm* — O'Keefe, Egan, Peterman & Enders LLP

(57) ABSTRACT

Systems and methods for packaging information handling systems such as notebook computers. Information handling systems may be configured in a bulk shipping configuration to allow multiple information handling system units to be shipped in a bulk configuration, and then converted to a single pack shipping configuration to allow an individual information handling system to be shipped separately and alone, or vice-versa.

15 Claims, 13 Drawing Sheets

SYSTEMS AND METHODS FOR PACKAGING OF INFORMATION HANDLING SYSTEMS

FIELD OF THE INVENTION

This invention relates generally to packaging, and more particularly to packaging for information handling systems.

BACKGROUND OF THE INVENTION

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Many corporate customers order hundreds of information handling systems in a single order from an information handling system manufacturer or assembler. A corporation that installs a company specific corporate software image has the system shipped from the manufacturer or assembler to a corporate customer information technology (IT) facility where the information handling systems are unpacked, re-imaged, re-packed, and sent to an end user. Examples of conventional packaging for so shipping information handling systems such as notebook computers include a corrugated cardboard box 102 as shown in FIG. 1. Within the corrugated box 102, a notebook computer 110 is supported and cushioned between a set of "Buns" (foam pads) 104*a* and 104*b*. Buns 104*a* and 104*b* include an internal opening 107 for receiving the notebook computer 110. Internal opening 107 of each bun 104 includes recessed surfaces 106 for supporting the notebook computer 110 as shown. Buns 104*a* and 104*b* come together around notebook computer 110 and mate at surfaces 108*a* and 108*b* which absorb weight of stack load that may be placed on box 102. The illustrated configuration of buns 104*a* and 104*b* adds a crush zone around the periphery of the notebook computer product 110 that helps prevent damage from drop or crush loads. Buns 104*a* and/or 104*b* may be provided with other internal recesses for containing accessories (e.g., such as AC adapter, battery, documentation, etc.) during shipping. The volume of such conventional box and bun packing material required to ship hundreds of information handling systems in this manner consumes large amounts of space and resources at corporate customer IT facilities. Multiple information handling systems may also be shipped in a single bulk container from a manufacturer or assembler to a corporate customer information technology (IT) facility.

Nested containers are common with plastic storage bins, buckets, trash cans, and disposable mail delivery bins. One example is illustrated in FIG. 2, which shows a stack 200 of nested recycle bins 202. The trapezoidal shape of each container allows one bin to drop into another bin as shown. Other examples include corrugated plastic nesting mail bins.

SUMMARY OF THE INVENTION

Disclosed herein are systems and methods that may be implemented to package information handling systems such as notebook computers. In one embodiment, the disclosed systems and methods may be implemented to allow multiple information handling system units (e.g., multiple notebook computers) to be shipped in a bulk configuration from a first physical location to a second and different physical location (e.g., shipped between first and second rooms in a given office, between first and second offices in a given city, between first and second cities, between first and second states or countries, between manufacturer and customer, etc.). Following bulk shipment, the disclosed packaging may be configured to convert to a single pack configuration after bulk shipping for further shipment of an individual information handling system separately to an end user at a third and different physical location. Besides notebook computers, the disclosed systems and methods may be implemented for packaging of other types of portable information handling systems and information handling systems (e.g., desktop computers, servers, computerized instruments, etc.) having varying form factors.

In one exemplary embodiment, the disclosed packaging systems and methods may be first employed for bulk shipment of multiple information handling systems in a nested bulk pack to a first (or intermediate) destination (e.g., to a corporate customer IT facility where the information handling systems may be unpacked and additional software installed, the software load modified, reinstalled, and/or actions taken to setup the system for an end user), and then converted for single pack shipping of the modified individual information handling systems to a second destination, e.g., to respective individual end users. Thus, the same packaging material may be employed for both bulk pack shipping of multiple information handling systems, and for single pack shipping of individual modified or re-imaged information handling systems from the intermediate destination to each system's final destination or end user. This may be employed to save space and resources at the first or intermediate destination, e.g., the corporate customer IT facilities, by reducing incoming pack volume and storage requirements, while allowing for single unit shipping out from the first or intermediate destination. Further, the disclosed packaging may alternatively be implemented first for single pack shipping followed by bulk shipping configuration, and may be converted from single pack shipping configuration to bulk shipping configuration and vice-versa multiple times as may be desired.

The disclosed systems and methods may employ a first shipping container (e.g., bin) that is dimensioned and configured to nest within another and second shipping container (e.g., bin) of like dimensions, in contrast to the conventional corrugated box configuration employed for individual packaging of notebook computers for shipment. The nesting depth of one shipping container within another shipping container may be controlled with a step structure provided in the container, such that the shipping containers nest in a fashion that stack load is transferred through the nested shipping container materials and such that there is substantially no stack load on the information handling system product being shipped.

In one exemplary embodiment of the practice of the disclosed systems and methods, nested shipping containers be utilized for bulk shipment of information handling systems to a first destination physical location, e.g., a corporate IT department, as follows. A first set of buns may be provided that is configured for placement within the bottom of each of the shipping containers in an interleaving manner with a second set of buns that forms a support well for supporting an information handling system, e.g., a notebook computer, within the shipping container. After so placing a set of such buns into the bottom of a first shipping container, a first information handling system (e.g., notebook computer) to be shipped may then be placed within the support well formed by the interleaved buns. A protective member such as a piece of protective foam or flat corrugated material may then be placed within the first shipping container on top of the first information handling system. A second and identical shipping container may then be placed on top of the first information handling system within the first shipping container. In this fashion, the first and second shipping containers are now nested and the second shipping container is ready to accept a second information handling system in the same manner as the first shipping container received the first information handling system, e.g., a second set of interleaved buns may then be placed with a second information handling system into the second shipping container in the same manner as the first information handling system and first set of buns were placed in the first shipping container. This process may be repeated multiple additional times with additional shipping containers being nested within each other, each shipping container containing a set of interleaved buns and an information handling system, until several information handling systems are stacked and palletized in nested stacks. A suitable quantity of sealing pack lids (e.g., corresponding to the number of shipping containers in each nested stack) may then be strapped to the top of each pallet and the information handling systems may be bulk shipped to the first or intermediate destination physical location.

At the first or intermediate destination physical location, e.g., a corporate IT department, a first shipping container is removed from the top of a nested stack and the information handling system therein is removed from the first container. At this point, the software of the information handling system may be, for example, re-imaged by having the original software image (e.g., operating system and/or software applications) replaced with the customer's corporate software image (e.g., corporate operating system and/or corporate software applications). One of the buns may then be removed from the bottom of the first shipment container. The information handling system may then be returned to the shipping container and placed in and/or on the remaining bun for bottom support. The bun that was previously removed may be flipped over and returned to the first shipping container on top of the information handling system for top of product protection. One of the sealing pack lids that was originally strapped to the top of the pallet may then be placed over the open top of the first shipping container to seal the first shipping container for single pack shipping. The shipping container is now configured as a single ship pack and may be shipped on to an end user at a second destination physical location. In other embodiments, a shipping container may alternatively be provided with an integral lid mechanism (e.g., box flaps) for sealing the open top of the shipping container.

In one exemplary embodiment, accessory containers may be incorporated within a nested shipping pack. For example, an accessory container may be configured to be expandable, e.g., as a pop-up box. At the first or intermediate physical location, the accessory container may be expanded by personnel at the intermediate physical location, and a corresponding accessory (e.g., documentation, power bricks, and other accessories) may be inserted into the expanded accessory container. In this fashion, accessories may be shipped in bulk containers to the first or intermediate physical location, and then deployed as necessary to meet the fulfillment needs of the end user. Accessory boxes may be included with a group of several information handling systems that are stacked and palletized in nested stacks, e.g., strapped to the top of each pallet. Alternatively, accessory boxes may be included within or inside the nested bulk packs.

In another exemplary embodiment, the nestable shipping containers may be configured for redeployment as recycling containers by the end user after use for bulk and single pack shipping, e.g., in conjunction with a "Green" recycling effort. In such an embodiment, this effort may be implemented to reduce pack material, simplify mass shipment to large customers, and to re-deploy the shipping container for another "Green" enabling use, e.g., for redeployment of the container to a municipality for other use/s.

In one respect, disclosed herein is a method for shipping an information handling system, including: providing a first information handling system; providing a first nestable shipping container, the first nestable shipping container having an open top end and a closed bottom end and being dimensioned and configured to nest with other nestable shipping containers of like dimensions and configuration; providing at least one first shipping bun unit within the first nestable shipping container with a first side of the at least one first shipping bun unit facing upward; providing at least one second shipping bun unit within the first nestable shipping container in a position on top of and in interleaving relationship with the first shipping bun unit, the second shipping bun unit having a first side facing upward; positioning the first information handling system within the first nestable shipping container in a bulk shipping configuration such that the first information handling system is received and at least partially cradled by at least one of the upward facing first side of the at least one second shipping bun unit that is on top of and interleaved with the at least one first shipping unit or the upward facing first side of the at least one first shipping bun unit; then positioning the closed bottom end of a second nestable shipping container of like configuration and dimensions as the first nestable shipping container into the open top end of the first nestable shipping container above the first and second shipping bun units and first information handling system in nested and stacked relationship, the second nestable container containing first and second shipping bun units of like configuration and dimension as the first and second shipping bun units within the first nestable shipping container and also containing a second information handling system that is received and at least partially cradled by at least one of the first and second shipping bun units within the second nestable shipping container; and then bulk shipping the first and second nestable containers together in the nested and stacked relationship from a first physical location to a second physical location.

In another respect, disclosed herein is a packaging system for shipping an information handling system, including: a first nestable shipping container having an open top end and a closed bottom end and being dimensioned and configured to nest with other nestable shipping containers of like dimensions and configuration; at least one first shipping bun unit configured for placement within the first nestable shipping container with a first side of the at least one first shipping bun facing upward, and at least one second shipping bun unit configured for placement within the first nestable shipping container in a position on top of and in interleaving relationship with the first shipping bun unit and with a first side of the second shipping bun unit facing upward such that at least one of the upward facing first side of the at least one second shipping bun unit or the upward facing first side of the at least one first shipping bun unit is configured to receive and at least partially cradle a first information handling system in a bulk shipping configuration; a second nestable shipping container of like configuration and dimensions as the first nestable shipping container and configured to be positioned into the open top end of the first nestable shipping container in nested and stacked relationship above the first and second shipping bun units and first information handling system when the first and second shipping bun units and first information handling system are positioned within the first nestable shipping container, the second nestable container configured to contain first and second shipping bun units of like configuration and dimension as the first and second shipping bun units of the first nestable shipping container and to also contain a second information handling system that is received and at least partially cradled by at least one of the first and second shipping bun units within the second nestable shipping container. The first side of the at least one first shipping bun unit may be also configured to receive and at least partially cradle the first information handling system in upward facing relationship without being in interleaving relationship with the at least one second shipping bun unit; and the at least one second shipping bun unit may be also configured to be positioned within the first nestable shipping container in a position on top of the first information handling system with the first side of the at least one second shipping bin unit facing downward such that the first information handling system is received and at least partially cradled between the downward facing first side of the at least one second shipping bun unit and the upward facing first side of the at least one first shipping bun unit in a single pack shipping configuration.

In another respect, disclosed herein is a method for re-packaging an information handling system, including: providing a first nestable shipping container having an open top end and a closed bottom end and being dimensioned and configured to nest with other nestable shipping containers of like dimensions and configuration; providing at least one first shipping bun unit, at least one second shipping bun unit, and the information handling system; and at least one of re-packaging the information handling system within the first nestable shipping container from a bulk shipping configuration to a single pack shipping configuration, or repackaging the information handling system within the first nestable shipping container from a single pack shipping configuration to a bulk shipping configuration. The bulk shipping configuration may be characterized by: the at least one first shipping bun unit being positioned within the first nestable shipping container with a first side of the at least one first shipping bun unit facing upward, the at least one second shipping bun unit being positioned within the first nestable shipping container in a position on top of and in interleaving relationship with the first shipping bun unit, the second shipping bun unit having a first side facing upward, the first information handling system being positioned within the first nestable shipping container such that the first information handling system is received and at least partially cradled by at least one of the upward facing first side of the at least one second shipping bun unit that is on top of and interleaved with the at least one first shipping unit or the upward facing first side of the at least one first shipping bun unit, and a closed bottom end of a second nestable shipping container of like configuration and dimensions as the first nestable shipping container being positioned within the open top end of the first nestable shipping container above the first and second shipping bun units and first information handling system in nested and stacked relationship. The single pack shipping configuration may be characterized by: the first information handling system being positioned within the first nestable shipping container such that the first information handling system is received and at least partially cradled by the first side of the at least one first shipping bun unit, and the at least one second shipping bun unit being positioned within the first nestable shipping container in a position on top of the first information handling system with the first side of the at least one second shipping bin unit facing downward such that the first information handling system is at least partially cradled between the downward facing first side of the at least one second shipping bun unit and the upward facing first side of the at least one first shipping bun unit in a single pack shipping configuration.

DESCRIPTION OF ILLUSTRATIVE EMBODIMENTS

Figure 1:
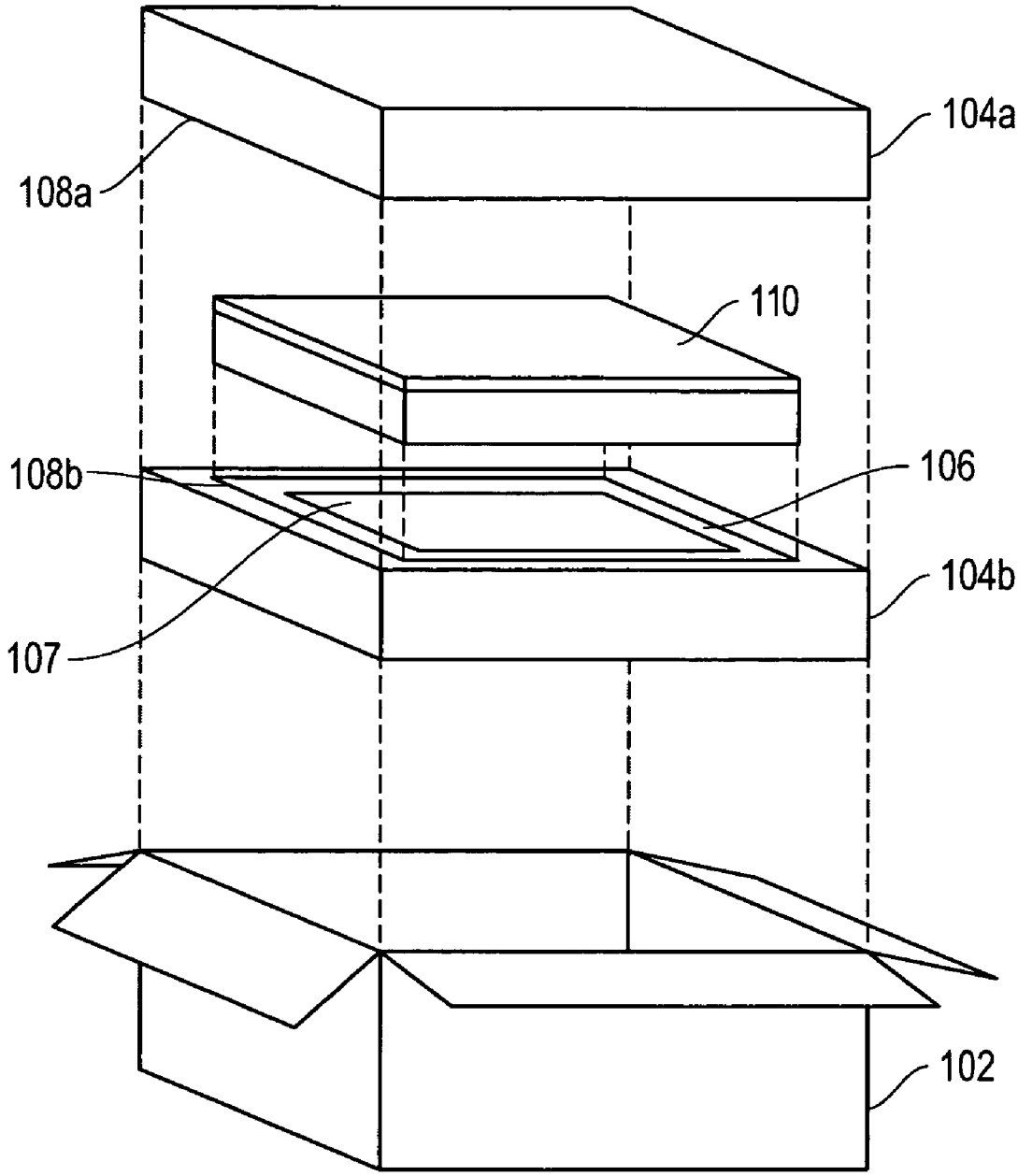
FIG. 1 (Prior Art)
FIG. 1 illustrates prior art packaging for an information handling system.
Figure 2:
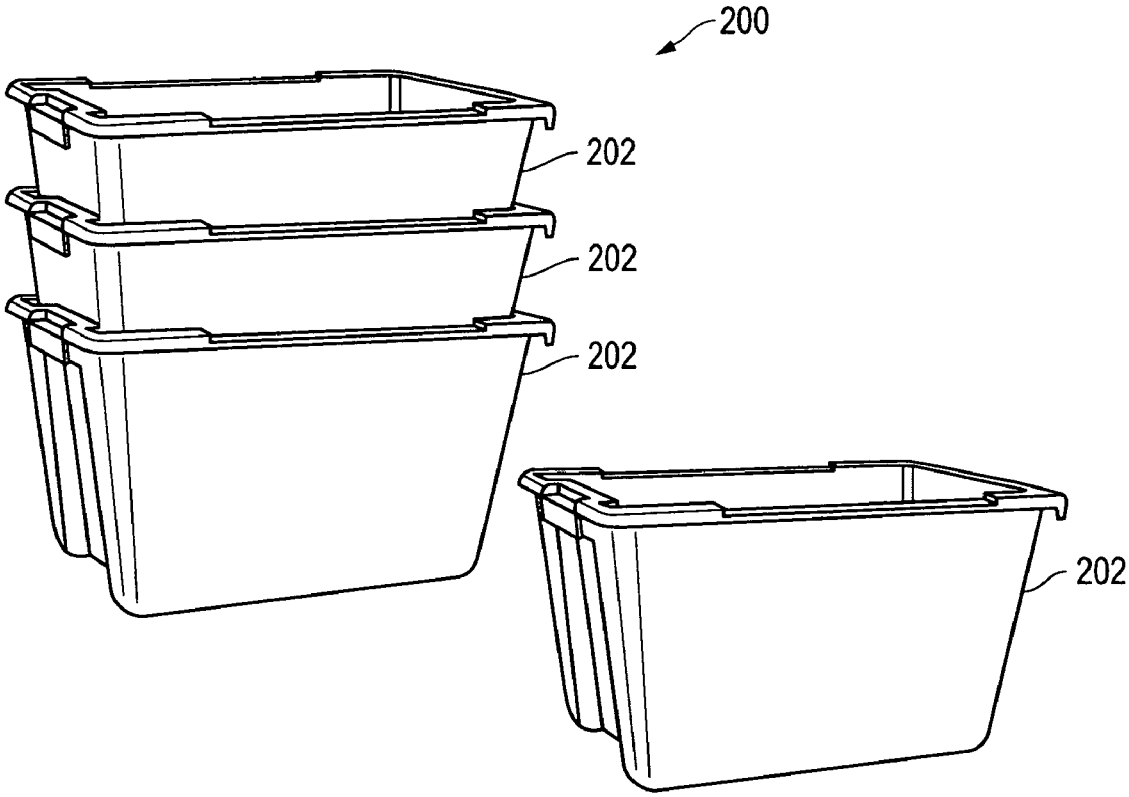
FIG. 2 (Prior Art)
FIG. 2 illustrates prior art nested recycle bins.
Figure 3:
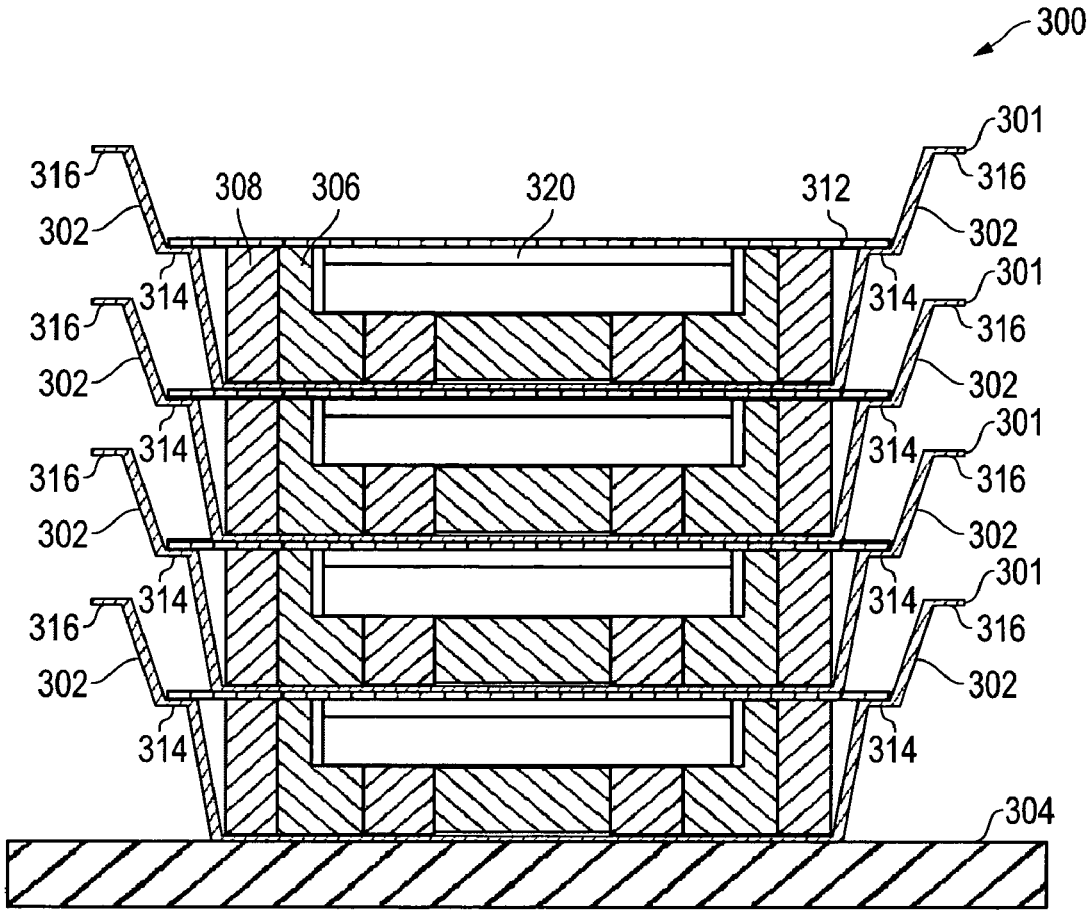
FIG. 3 is a simplified side cross sectional illustration of a stack of nested shipping containers according to one exemplary embodiment of the disclosed systems and methods.
Figure 5:
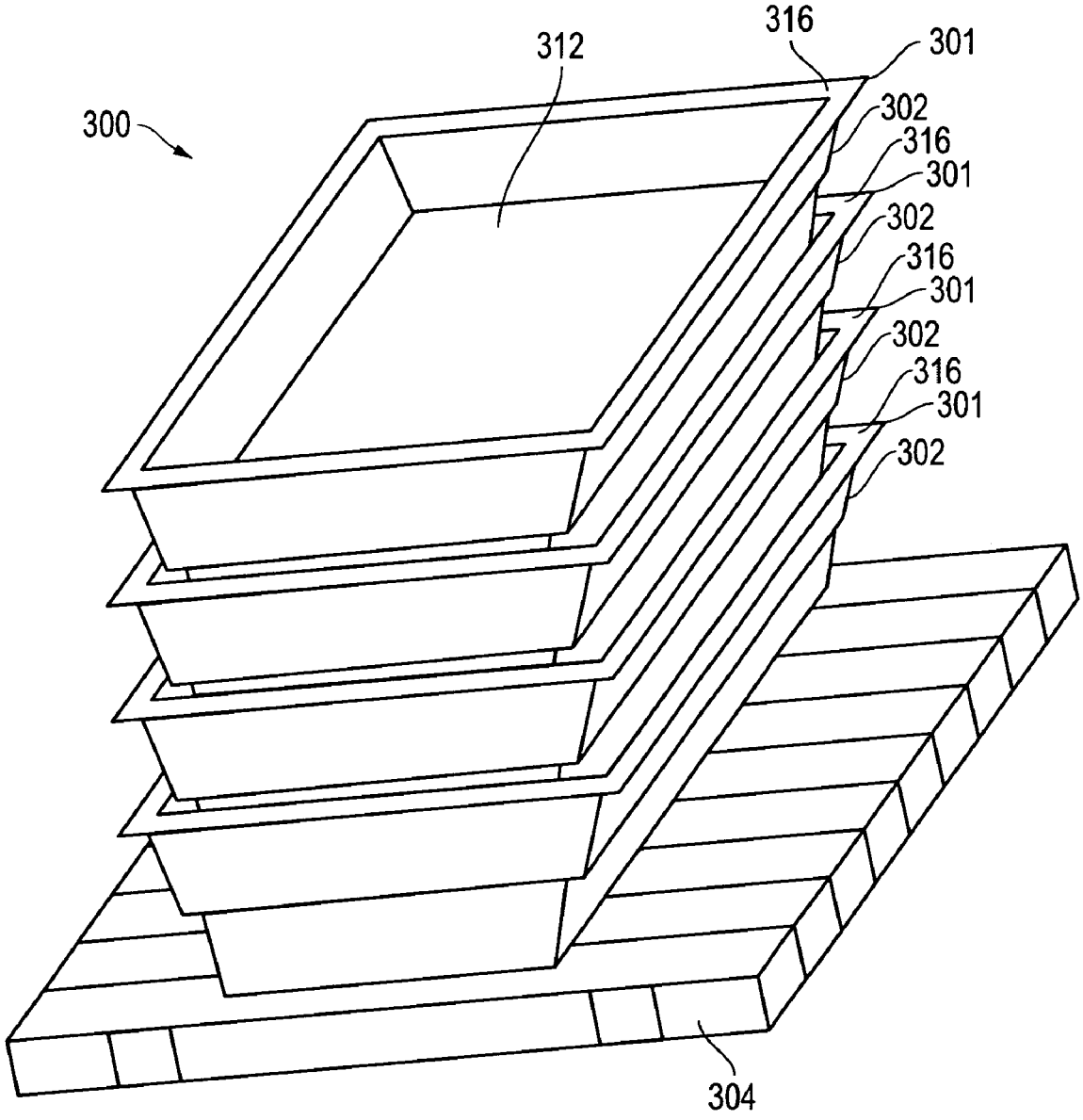
FIG. 5 is a perspective view of the stack system of FIG. 3.

FIGS. 3 and 5 illustrate a stack 300 of nested shipping containers 301, e.g., as may be employed for bulk shipping from an initial physical location (e.g., information handling system assembly facility) to an intermediate physical location (e.g., corporate customer IT department location) for software re-imaging/modification/system setup according to one exemplary embodiment of the disclosed systems and methods. Each of nested shipping containers 301 may be constructed of any material suitable for containing, stacking, and shipping items such as information handling systems including, but not limited to, corrugated cardboard, plastic, waxed paper, fiberglass, etc. As shown, stack 300 of nested shipping containers 301 may optionally be supported on a pallet 304, e.g., to facilitate easy bulk handling in a warehouse environment by a fork lift or other equipment.

Each of nested shipping containers 301 of FIG. 3 has sidewalls 302 that are outwardly angled from the bottom of the respective container 301 toward the top (opening) end of the respective shipping container 301 and dimensioned in a manner that allows the bottom end of another shipping container 301 to be received through the top opening end of the respective shipping container in a nesting fashion, e.g., such that a bottom portion of a first shipping container 301 is contained within the interior of a top portion of an adjacent shipping container. As shown an optional peripheral container sealing lip 316 is provided for each of containers 301.

Still referring to FIG. 3, a respective portable information handling system (in this example a notebook computer 320) is received in each shipping container 301 as shown. Each of nested shipping containers 301 of stack 300 further contains a first set of shipping buns 306 and a second set of shipping buns 308 that are each disposed within the bottom of the container 301 underneath a respective notebook computer 320 in interleaving fashion such that the notebook computer contained therein is supported and substantially centered within its respective shipping container 301. Individual buns of first set shipping buns 306 and second set shipping buns 308 may be individually placed as individual shipping bun units within a respective shipping container 301 in the configuration shown, or may be linked or otherwise assembled together with another material to form an integrated first shipping bun unit 602 and/or integrated second shipping bun unit 606 that may be placed into the shipping container 301, as will be described further herein. Alternatively, a shipping bun unit may formed as one integral piece of material (e.g., as a single integral piece of shaped shipping foam) formed and shaped to provide the functionality of multiple buns 306 or 308, and/or the functionality of a single shipping bun unit 602 or 606 may be performed by two or more multiple bun units that cooperate to receive and protect an information handling system for bulk or single pack shipping in a manner as described further herein. In one embodiment, shipping buns 306 and 308 may be constructed of any relatively lightweight material suitable for supporting stack load and dampening shock forces during shipping, e.g., foam, corrugated cardboard, high impact polystyrene (HIPS), Expanded Foam, etc.

An optional separator structure (e.g. sheet) 312 (e.g., corrugated cardboard, plastic, waxed paper, paper, etc.) is shown as it may be positioned on top of the notebook computer 320 of each shipping container 301 and as it may be supported by an optional internal step structure 314 provided within each shipping container 301. In such a configuration, each separator 312 may be so provided to absorb and transfer substantially all of the overhead stack load from other shipping containers to step structure 314 of its respective shipping container 301 such that substantially no stack load is transferred to the notebook computer 320 contained therein.

Figure 4:
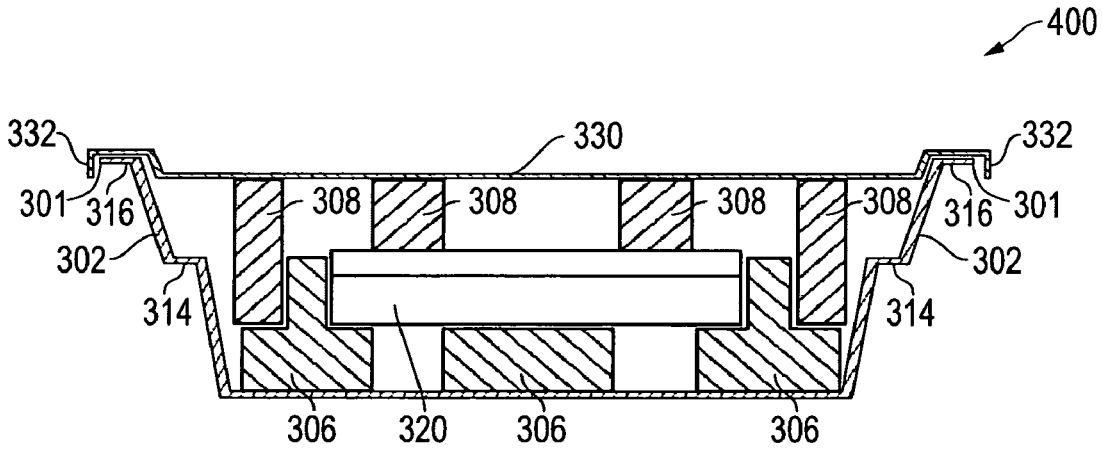
FIG. 4 is a simplified side cross sectional illustration of a nestable shipping container in a single pack configuration according to one exemplary embodiment of the disclosed systems and methods.
Figure 6:
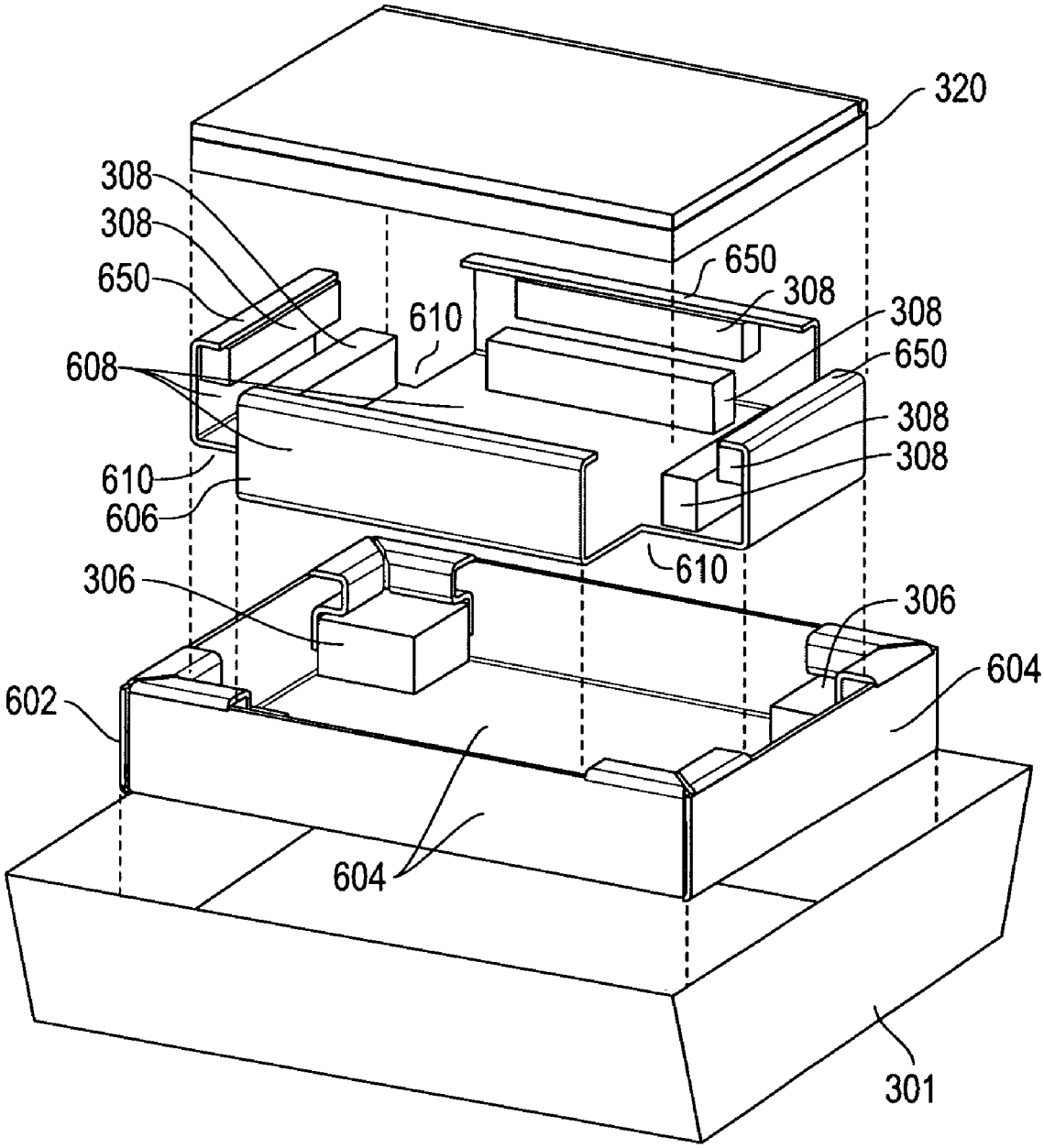
FIG. 6 is an exploded perspective view of shipping bins and a portable information handling system positioned relative to each other according to one exemplary embodiment of the disclosed systems and methods.

FIG. 4 is a simplified cross sectional illustration of one of nestable shipping containers 301 of FIG. 3 that has been reconfigured to a single pack configuration 400, e.g., such as may be employed for shipping an individual information handling system from an intermediate physical location (e.g., corporate customer IT department location) after software re-imaging/modification/system setup to a final destination physical location (e.g., end user) according to one exemplary embodiment of the disclosed systems and methods. As shown in FIG. 4, optional separator structure 312 has been removed, and second set shipping buns 308 have been repositioned on top of notebook computer 320 with second set shipping buns 308 left in the previous position such that notebook computer 320 is now sandwiched between first set shipping buns 306 and second set shipping buns 308 in a manner that helps protect and isolate notebook computer 320 from external shock to which the single pack shipping container 301 may be subjected during shipping. A lid 330 has been placed on top of single pack shipping container 301 to seal it for shipment, e.g., with optional lid sealing lip sealably mating with container FIG. 6 illustrates one exemplary embodiment showing an exploded view of first set shipping bins 306, second set shipping buns 308 and notebook computer 320 positioned relative to each other for insertion into a nestable shipping container 301, e.g., for bulk shipping from a first assembly facility location to an intermediate corporate IT facility location. In the embodiment of FIG. 6, first set shipping buns 306 are assembled together as part of a first shipping bun unit 602 that includes a box-like first bun interconnecting structure 604 that has a bottom and four sides (e.g., corrugated cardboard, plastic, waxed paper, etc.) that holds first set shipping buns 306 together relative to each other in position to interface with notebook computer 301 during shipping. Similarly, second set shipping buns 308 of this exemplary embodiment are assembled together as part of a second shipping bun unit 606 that includes a box-like second bun interconnecting structure 608 (e.g., corrugated cardboard, plastic, waxed paper, fiberglass, etc.) that holds second set shipping buns 308 together relative to each other in position to interface with notebook computer 301 during shipping, and which also includes optional support surfaces 650 the purpose of which will be described further herein. As further shown, each of first set shipping buns 306 of FIG. 6 are corner shipping buns positioned in the four corners of interconnecting structure 604, and interconnecting structure 608 has complementary corner cut-out openings 610 that are positioned and dimensioned complementary to receive and mate with corner shipping buns 306, i.e., to allow clearance for interconnection structure 608 to be fully received within interconnecting structure 604. In this regard, second shipping bun unit 606 is configured and dimensioned to be inserted down into first shipping bun unit 602 so that second set shipping buns 308 interleave with first set shipping buns 306 to receive and support notebook computer 320 for bulk shipping in a shipping container 301, as shown in cross section in FIG. 7.

Figure 7:
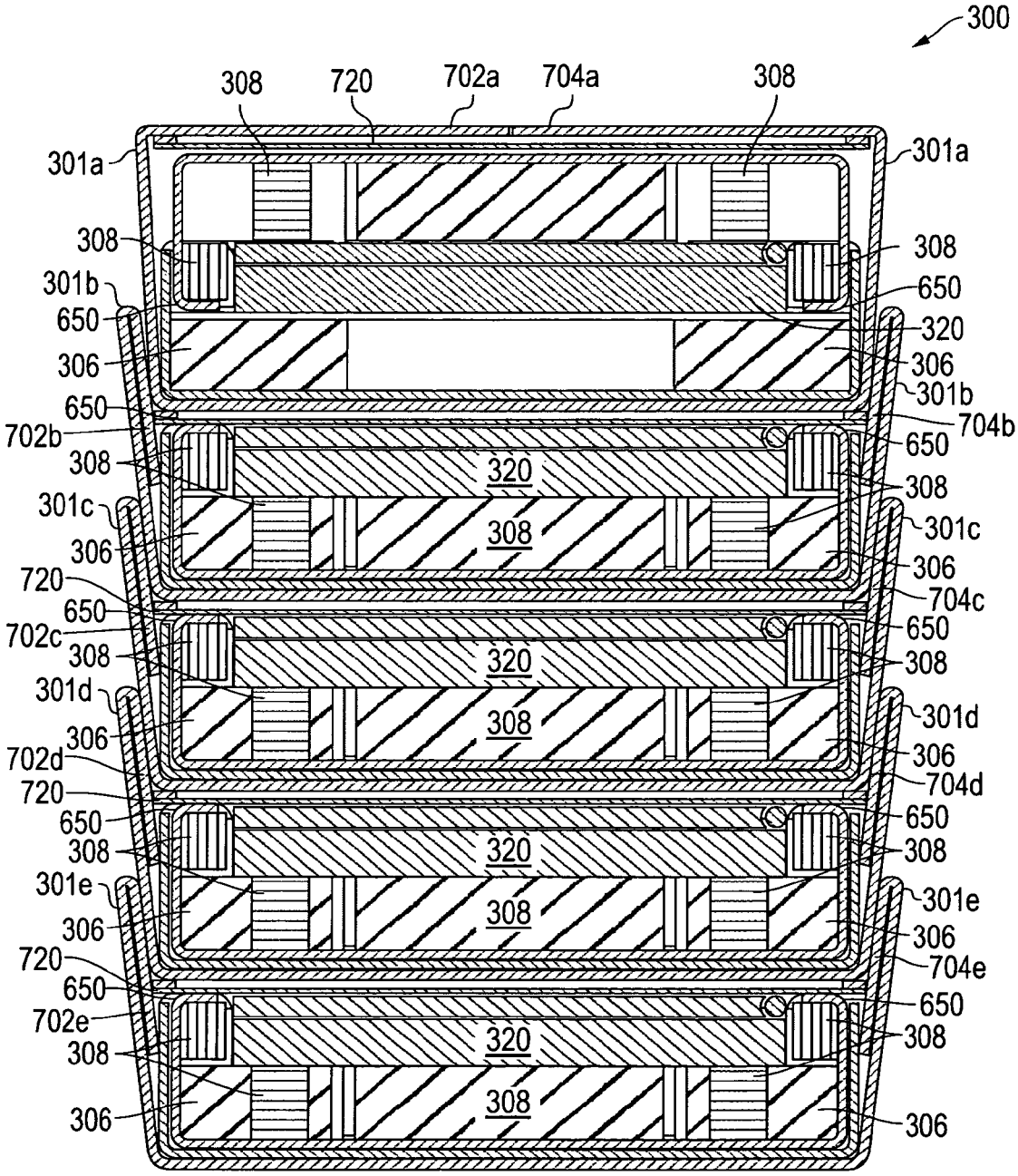
FIG. 7 is a side cross sectional view of a stack of nested shipping containers according to one exemplary embodiment of the disclosed systems and methods.

In particular, FIG. 7 shows a cross-sectional view of stack 300 of four shipping containers **301*b*-301*e* that are nested within each other in the manner as previously described. A fifth shipping container 301*a* having notebook computer 320 positioned therein in single pack configuration is shown nested on top of stack 300. As shown, fifth shipping container 301*a* is provided with hinged flaps 702*a* and 704*a* that close over the top of fifth shipping container 301*a* to secure the stack for shipping, e.g., strapped to a pallet. Although two hinged flaps 702 and 704 are visible in the cross sectional view of FIG. 7 for each container 301, it will be understood that there may be four hinged flaps for each container 301, with one extending inward from each side of the rectangularshaped container opening. As shown, hinged flaps 702 and 704 of each of the remaining shipping containers 301***b*-301*e* may be folded down and into the respective container 301 to which they are attached. As shown, an optional protective layer 720 of corrugated or other material may be present to prevent scratching or damage to the surface of the notebook computer 320 contained within each container 301.

Figure 8:
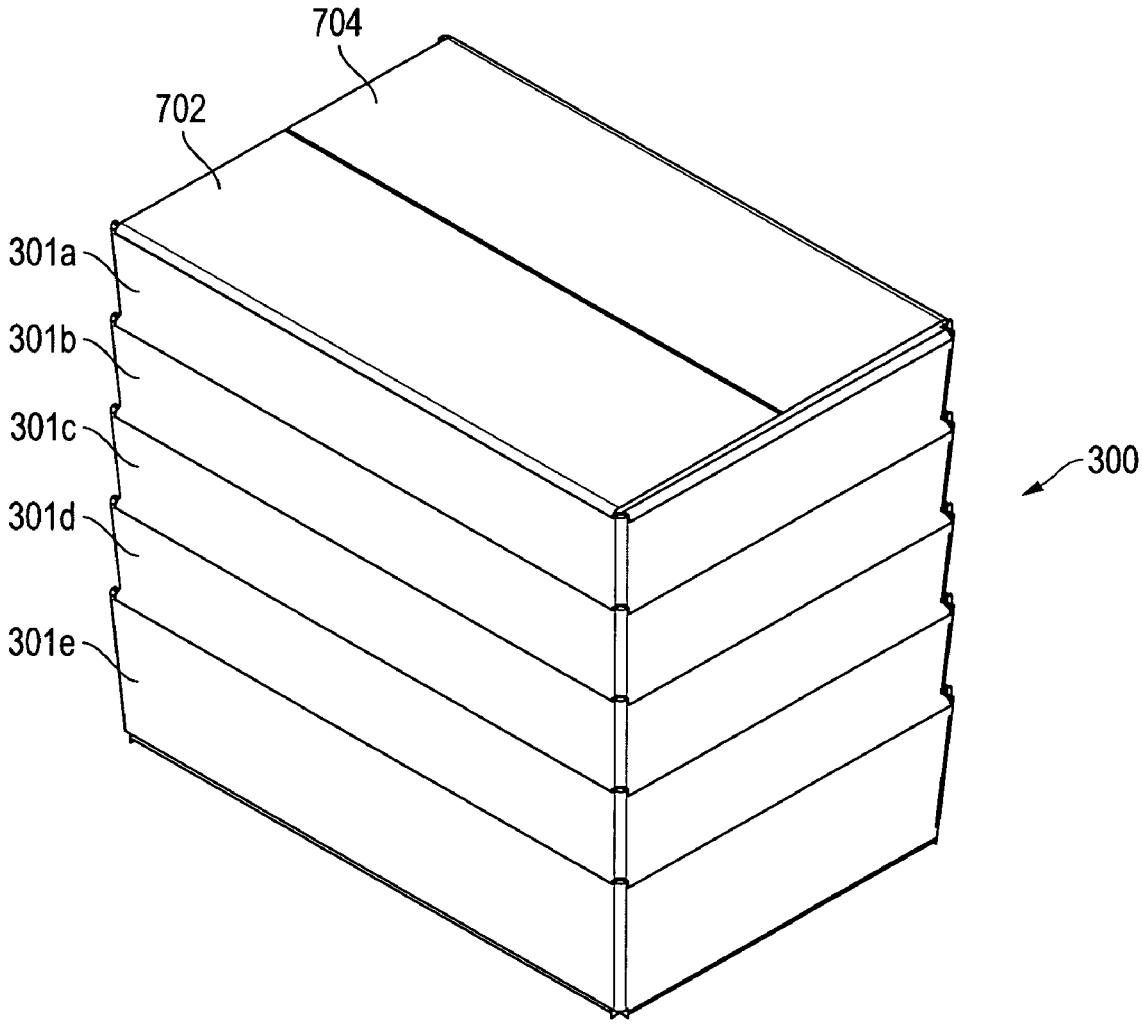
FIG. 8 is a perspective view of a stack of nested shipping containers according to one exemplary embodiment of the disclosed systems and methods.

In the exemplary embodiment of FIG. 7, each second shipping bun unit 606 is configured with optional support surfaces 650 that extend upward to contact and support the bottom of the next nested shipping container above as shown in FIG. 7 so as to absorb stack load from the nested shipping container materials above, and to transfer this load around the information handling system to the bottom of its corresponding nested shipping container 301 such that there is substantially no stack load on the notebook computer 320 being bulk shipped. For purposes of illustration only in FIG. 7, shipping buns 308 of shipping containers 301*b*-301*e* are shown extending through corner shipping buns 306 underneath notebook computer 320, although shipping buns 308 are actually positioned behind corner shipping buns 306 when in bulk shipping configuration. Also, for purposes of illustration only in FIG. 7, side shipping buns 308 of shipping containers 301*b*-301*e* (i.e., those positioned adjacent and in contact with the sides of notebook computer 320) are not shown in FIG. 7. FIG. 8 shows stack 300 of shipping containers 301*a*-301*e* in perspective view.

Figure 9:
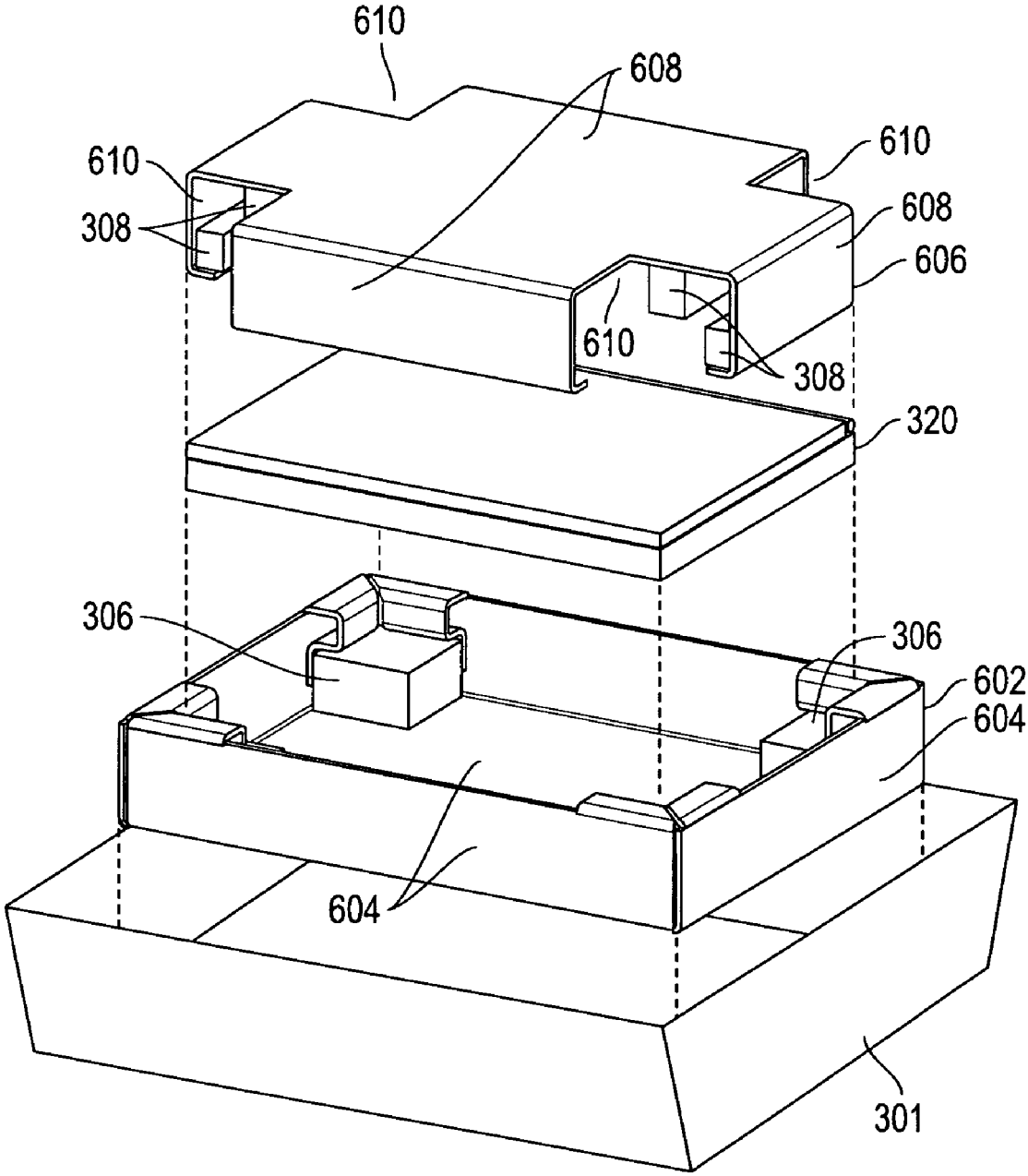
FIG. 9 illustrates an exploded view of first set shipping bins, second set shipping buns and notebook computer according to one exemplary embodiment of the disclosed systems and methods.

FIG. 9 illustrates an exploded view of first set shipping bins 306, second set shipping buns 308 and notebook computer 320 of FIG. 6 as they may be repositioned from bulk shipping configuration of FIG. 6 to single pack shipping configuration in the same nestable shipping container 301, e.g., for single pack shipping from an intermediate corporate IT facility location to an end user. As shown in FIG. 9, notebook computer 320 and second shipping bun unit 606 may be removed from nestable shipping container 301, and reoriented such that notebook computer 320 is now positioned between first shipping bun unit 602 and second shipping bun unit 606 as shown, and then reinserted into nestable shipping container 301 for single pack shipping.

Figure 10:
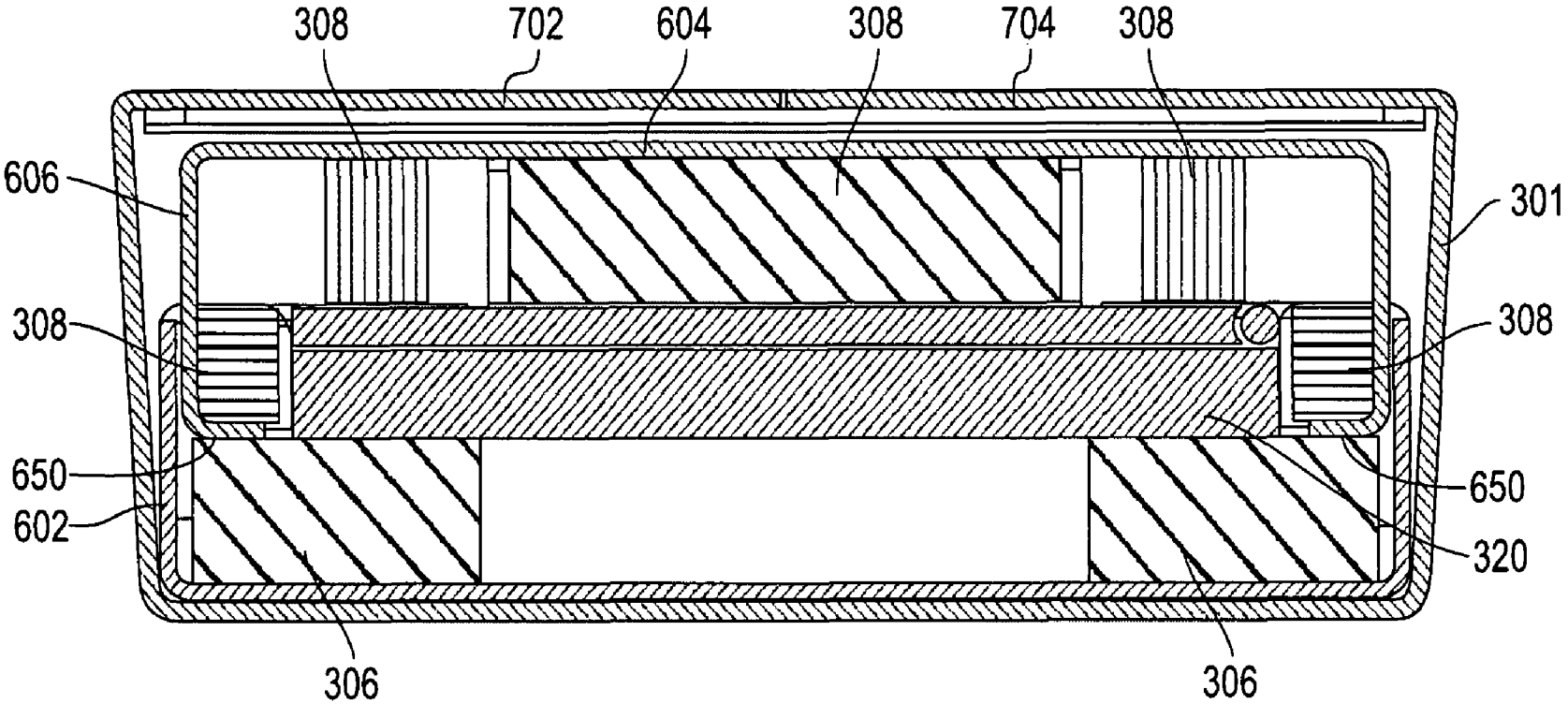
FIG. 10 is a side cross-sectional view of a single pack shipping configuration according to one exemplary embodiment of the disclosed systems and methods.

FIG. 10 shows a cross-sectional view of the single pack shipping configuration of FIG. 9 inside a nestable shipping container 301, with notebook computer 320 now inserted into and received by first shipping bun unit 602 such that notebook computer 320 is cradled from underneath at the corners by first set shipping bins 306, and overlain by second shipping bun unit 606, which at least partially overlays the top and at least partially surround the sides of notebook computer 320 for protection during single pack shipping. Optional flaps 702 and 704 are shown closed to seal the top of shipping container 301.

Figure 11:
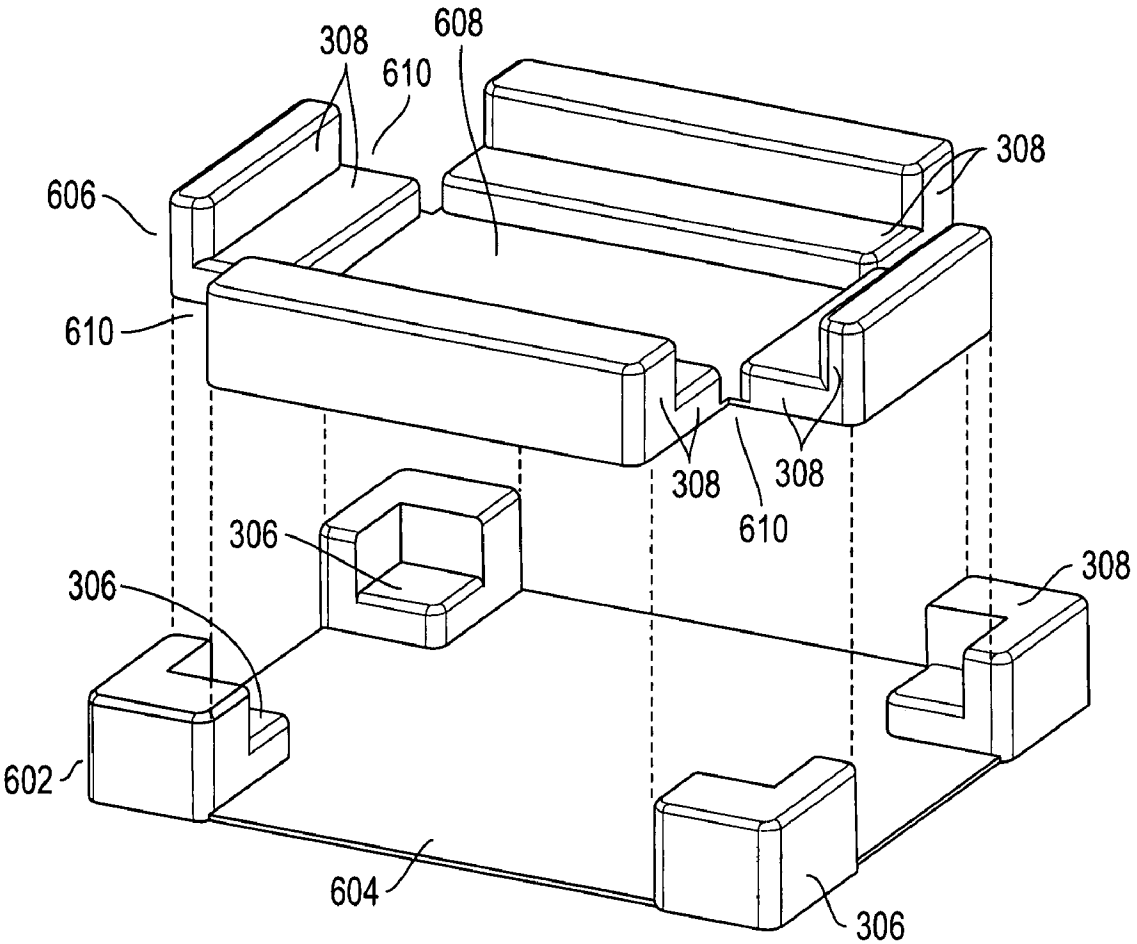
FIG. 11 is an exploded perspective view of a first shipping bun unit and second shipping bun unit according to one exemplary embodiment of the disclosed systems and methods.

It will be understood that the particular embodiments illustrated in FIGS. 3-10 are exemplary only, and that other configurations of first and second shipping bun units, first and second set shipping buns and/or first and second bun interconnecting structures may be employed in the practice of the disclosed systems and methods. For example, FIG. 11 illustrates another exemplary embodiment of a first shipping bun unit 602 and corresponding second shipping bun unit 606. In this alternate embodiment, first shipping bun unit 602 includes four corner-shaped first set shipping buns 306 positioned and held in place at each of four corners by a substantially planar first bun interconnecting structure 604, e.g., in a position to receive and cradle a notebook computer 320 at its four corners. As shown in FIG. 11, second shipping bun unit 606 includes four angular-shaped second set shipping buns 308 that are positioned and held in place by substantially planar second bun interconnecting structure 608, e.g., in position to receive and cradle a notebook computer 320 at four of its side edges. FIG. 11 shows first and second shipping bun units 602 and 606 in an exploded positioned for insertion into a nestable shipping container in a bulk shipping configuration, and FIG. 12 shows first and second shipping bun units 602 and 606 assembled together in bulk shipping configuration.

Figure 12:
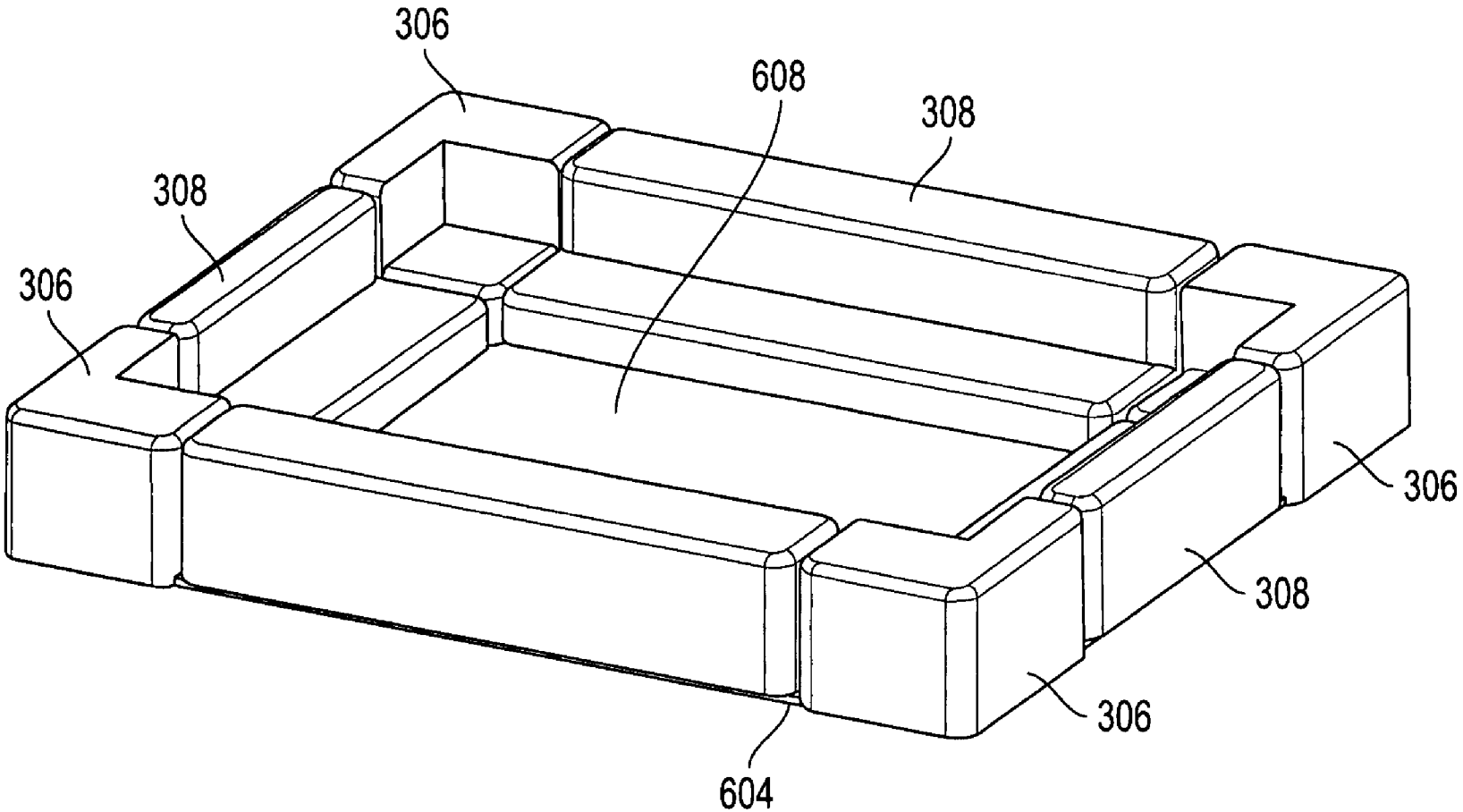
FIG. 12 is a perspective view of a first shipping bun unit and second shipping bun unit according to one exemplary embodiment of the disclosed systems and methods.
Figure 13:
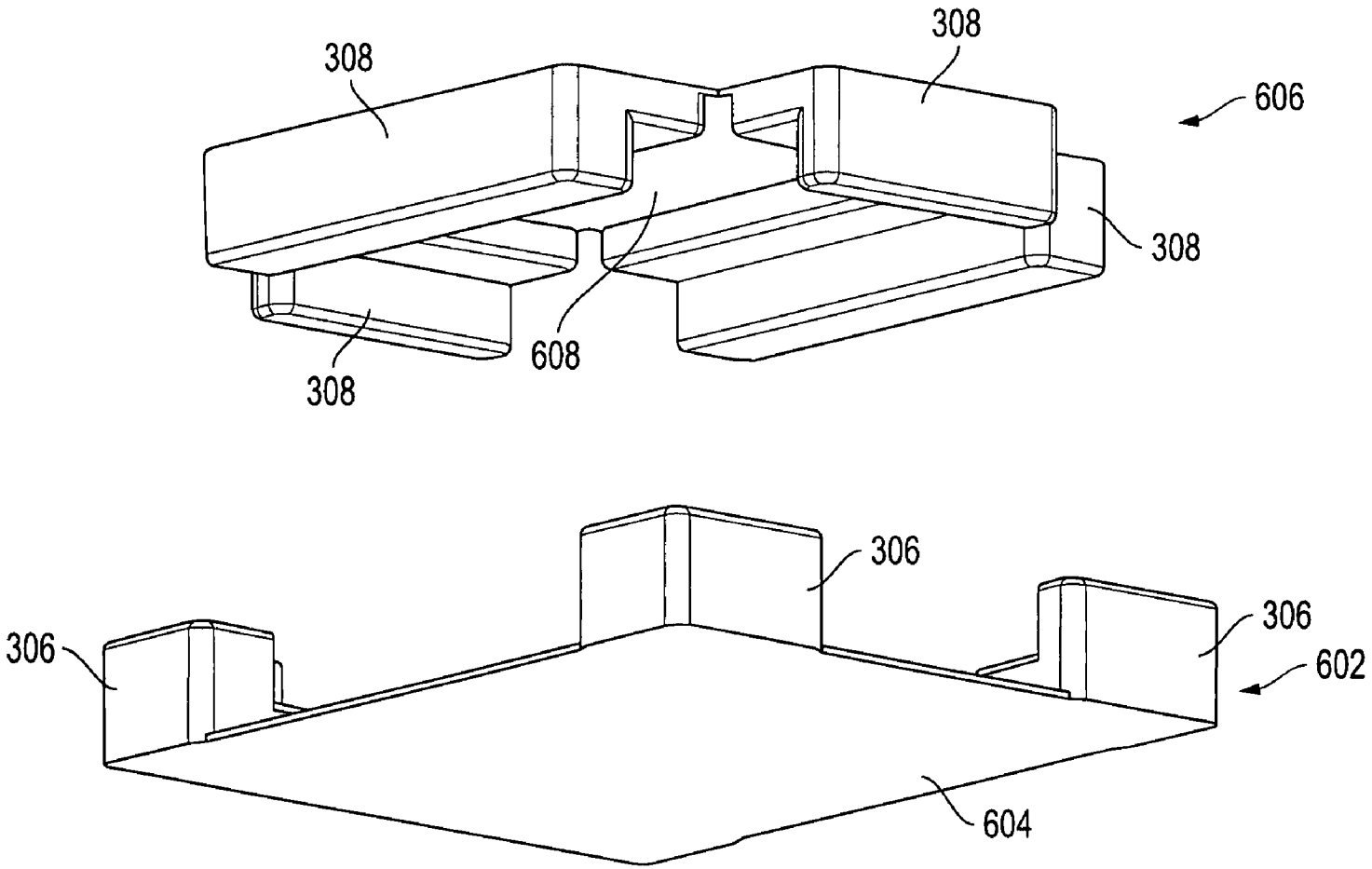
FIG. 13 is an exploded perspective view of a first shipping bun unit and second shipping bun unit according to one exemplary embodiment of the disclosed systems and methods.
Figure 14:
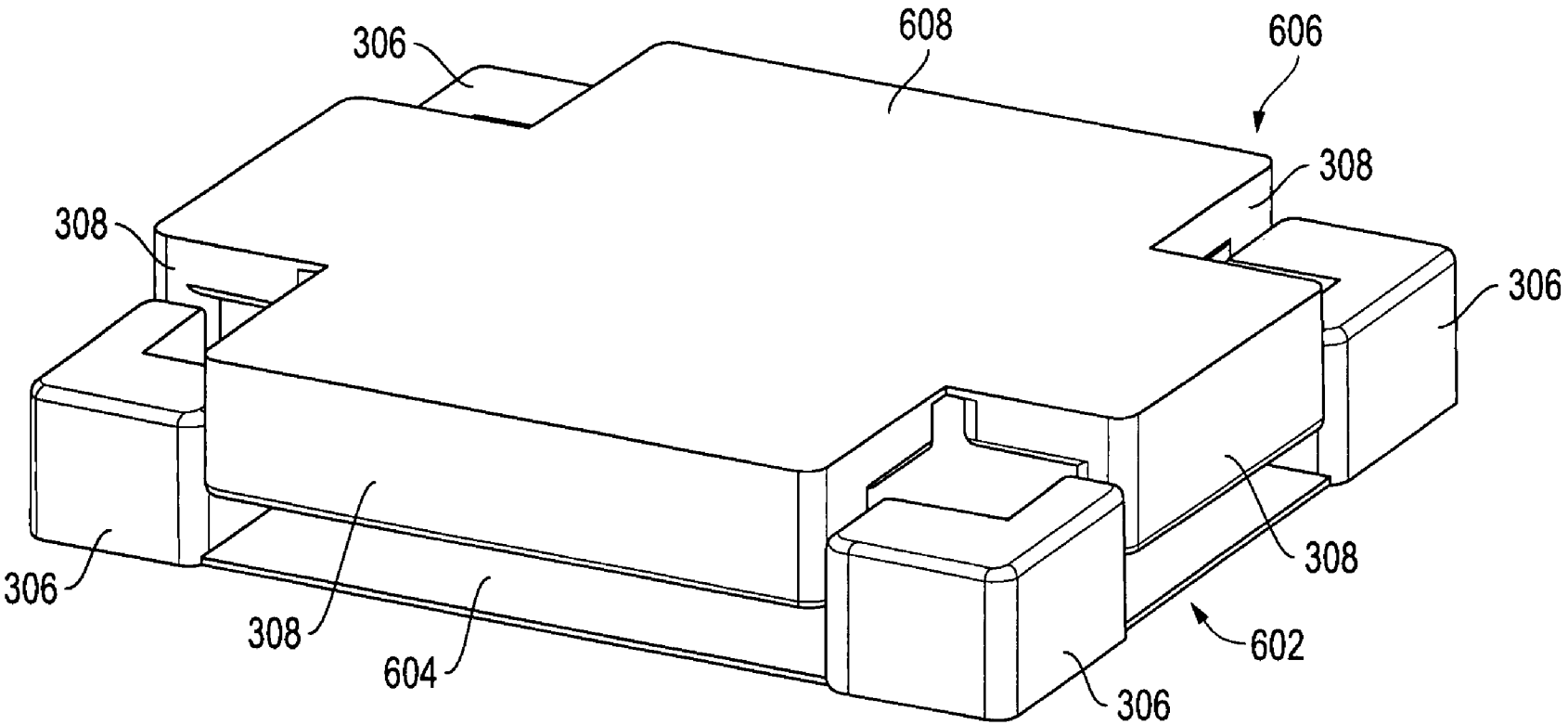
FIG. 14 is a perspective view of a first shipping bun unit and second shipping bun unit according to one exemplary embodiment of the disclosed systems and methods.

FIGS. 13 and 14 show first and second shipping bun units 602 and 606 of FIGS. 11 and 12 alternately positioned for single pack shipping within a nestable shipping container 301. In this regard, FIG. 13 shows first and second shipping bun units 602 and 606 in an exploded positioned for insertion into a nestable shipping container in single pack shipping configuration (i.e., with second shipping bun unit 606 inverted relative to its position in bulk shipping configuration of FIG. 11) for receiving and cradling a notebook computer 320 therebetween. FIG. 14 shows first and second shipping bun units 602 and 606 fully assembled together in single pack shipping configuration.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communications between the various hardware components.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed systems and methods may be utilized in various combinations and/or independently. Thus the invention is not limited to only those combinations shown herein, but rather may include other combinations.

What is claimed is:

1. A method for shipping an information handling system, comprising:

providing a first information handling system;

providing a first nestable shipping container, the first nestable shipping container having an open top end and a closed bottom end and being dimensioned and configured to nest with other nestable shipping containers of like dimensions and configuration;

providing at least one first shipping bun unit within the first nestable shipping container with a first side of the at least one first shipping bun unit facing upward;

providing at least one second shipping bun unit within the first nestable shipping container in a position on top of and in interleaving relationship with the first shipping bun unit, the second shipping bun unit having a first side facing upward;

positioning the first information handling system within the first nestable shipping container in a bulk shipping configuration such that the first information handling system is received and at least partially cradled by at least one of the upward facing first side of the at least one second shipping bun unit that is on top of and interleaved with the at least one first shipping unit or the upward facing first side of the at least one first shipping bun unit;

then positioning the closed bottom end of a second nestable shipping container of like configuration and dimensions as the first nestable shipping container into the open top end of the first nestable shipping container above the first and second shipping bun units and first information handling system in nested and stacked relationship, the second nestable container containing first and second shipping bun units of like configuration and dimension as the first and second shipping bun units within the first nestable shipping container and also containing a second information handling system that is received and at least partially cradled by at least one of the first and second shipping bun units within the second nestable shipping container; and then bulk shipping the first and second nestable containers together in the nested and stacked relationship from a first physical location to a second physical location.

2. The method of claim 1, further comprising:

providing at least one additional information handling system;

providing at least one additional nestable shipping container, the additional nestable shipping container having an open top end and a closed bottom end and being dimensioned and configured to nest with other nestable shipping containers of like dimensions and configuration;

providing at least one additional first shipping bun unit within the additional nestable shipping container with a first side of the additional first shipping bun unit facing upward;

providing at least one additional second shipping bun unit within the additional nestable shipping container in a position on top of and in interleaving relationship with the additional first shipping bun unit, the additional second shipping bun unit having a first side facing upward;

positioning the additional information handling system within the additional nestable shipping container in a bulk shipping configuration such that the additional information handling system is received and at least partially cradled by at least one of the upward facing first side of the at least one additional second shipping bun unit that is on top of and interleaved with the at least one additional first shipping unit or the upward facing first side of the at least one additional first shipping bun unit;

positioning the closed bottom end of the first nestable shipping container into the open top end of the additional nestable shipping container above the additional first and second shipping bun units and additional information handling system in nested and stacked relationship; and then bulk shipping the first, second and at least one additional nestable containers together in the nested and stacked relationship from a first physical location to a second physical location.

3. The method of claim 1, further comprising:

receiving the first and second nestable containers together in the nested and stacked relationship at the second physical location;

then removing the second nestable container from the open top end of the first nestable shipping container at the second physical location;

then removing the first information handling system and the at least one second shipping bun unit from within the first nestable shipping container;

then positioning the first information handling system back within the first nestable shipping container such that the first information handling system is received and at least partially cradled by the first side of the at least one first shipping bun unit;

then positioning the at least one second shipping bun unit within the first nestable shipping container in a position on top of the first information handling system with the first side of the at least one second shipping bin unit facing downward such that the first information handling system is at least partially cradled between the downward facing first side of the at least one second shipping bun unit and the upward facing first side of the at least one first shipping bun unit in a single pack shipping configuration.

4. The method of claim 3, further comprising providing and positioning a sealing pack lid over the open top end of the first nestable container at the second physical location prior to shipping the first nestable container as a single pack from the second physical location to a third physical location.

5. The method of claim 1, wherein the first information handling system is bulk shipped from the first physical location to the second physical location having a first software image, first software load, or first software configuration; and further comprising performing at least one of the following actions after removing the first information handling system from within the first nestable shipping container and before positioning the first information handling system back within the first nestable shipping container for the individual shipping as a single pack form the second location to the third location:

re-imaging the software of the first information handling system with a different and second software image at the second physical location;

modifying the software load of the first information handling system;

installing additional software on the first information handling system;

setting up the computer software configuration for an end user; or a combination thereof.

6. The method of claim 1, further comprising providing the at least one second shipping bun unit within the first nestable shipping container in a position on top of and in interleaving relationship with the first shipping bun unit such that the first side of the second shipping bun unit faces upward and receives and at least partially cradles the first information handling system in cooperation with the first side of the first shipping bun unit.

7. The method of claim 1, wherein the first nestable shipping container further comprises an internal step structure; and wherein the method further comprises providing and positioning a separator structure within the first nestable shipping container and on top of the first information handling system positioned therein such that the separator structure is supported by the internal step structure; and then positioning the closed bottom end of the second nestable shipping container into the open top end of the first nestable shipping container onto the separator structure such that the separator structure absorbs and transfers substantially all of the overhead stack load from the second nestable shipping container to the internal step structure such that substantially no stack load is transferred from the second nestable shipping container to the first information handling system within the first nestable shipping container.

8. The method of claim 1, wherein the first side of the at least one second shipping bun unit comprises one or more support surfaces; and wherein the method further comprises positioning the at least one second shipping bun unit within the first nestable shipping container with the first information handling system received and at least partially cradled by the first side of the at least one second shipping bun such that the one or more support surfaces extend upward to contact and support the closed bottom end of the second nestable shipping container such that the one or more support surfaces absorb and transfer substantially all of the overhead stack load from the second nestable shipping container such that substantially no stack load is transferred from the second nestable shipping container to the first information handling system within the first nestable shipping container.

9. The method of claim 1, wherein the first and second information handling systems are each notebook computers.

10. The method of claim 1, further comprising:

at least one of re-packaging the first information handling system within the first nestable shipping container from the bulk shipping configuration to a single pack shipping configuration, or repackaging the first information handling system within the first nestable shipping container from a single pack shipping configuration to the bulk shipping configuration; and wherein the single pack shipping configuration is characterized by:

the first information handling system being positioned within the first nestable shipping container such that the first information handling system is received and at least partially cradled by the first side of the at least one first shipping bun unit, and the at least one second shipping bun unit being positioned within the first nestable shipping container in a position on top of the first information handling system with the first side of the at least one second shipping bin unit facing downward such that the first information handling system is at least partially cradled between the downward facing first side of the at least one second shipping bun unit and the upward facing first side of the at least one first shipping bun unit in a single pack shipping configuration.

11. The method of claim 10, wherein the first information handling system is initially packaged in the bulk shipping configuration with a first software image; and wherein the method further comprises re-imaging the software of the first information handling system with a different and second software image, and then re-packaging the information handling system within the first nestable shipping container in the single pack shipping configuration.

12. The method of claim 10, wherein the single pack shipping configuration is further characterized by the at least one second shipping bun unit being provided within the first nestable shipping container in a position on top of and in interleaving relationship with the first shipping bun unit such that the first side of the second shipping bun unit faces upward and receives and at least partially cradles the first information handling system in cooperation with the first side of the first shipping bun unit.

13. The method of claim 10, wherein the first nestable shipping container further comprises an internal step structure; wherein the method further comprises providing a separator structure; and wherein the bulk shipping configuration is further characterized by the separator structure being positioned within the first nestable shipping container and on top of the first information handling system such that the separator structure is supported by the internal step structure, and the closed bottom end of the second nestable shipping container is positioned within the open top end of the first nestable shipping container on the separator structure such that the separator structure absorbs and transfers substantially all of the overhead stack load from the second nestable shipping container to the internal step structure such that substantially no stack load is transferred from the second nestable shipping container to the first information handling system within the first nestable shipping container.

14. The method of claim 10, wherein the first side of the at least one second shipping bun unit comprises one or more support surfaces; and wherein the bulk shipping configuration is further characterized by the at least one second shipping bun unit being positioned within the first nestable shipping container with the first information handling system received and at least partially cradled by the first side of the at least one second shipping bun such that the one or more support surfaces extend upward to contact and support the closed bottom end of the second nestable shipping container such that the one or more support surfaces absorb and transfer substantially all of the overhead stack load from the second nestable shipping container such that substantially no stack load is transferred from the second nestable shipping container to the first information handling system within the first nestable shipping container.

15. The method of claim 10, wherein the first and second information handling systems are each notebook computers.

* * * * *